United States Patent [19]

Williams

[11] 4,102,547

[45] Jul. 25, 1978

[54] SCAVENGING DEVICE FOR ANIMAL WASTE

[76] Inventor: Rollin T. Williams, 224 N. Franklin St., Allentown, Pa. 18102

[21] Appl. No.: 852,662

[22] Filed: Nov. 18, 1977

[51] Int. Cl.[2] ..... A47F 13/08; A01K 29/00

[52] U.S. Cl. ..... 294/1 R; 294/55; 15/257.3

[58] Field of Search ..... 294/1 R, 19 R, 55, 57, 294/53.5, 50.9, 100, 101; 15/257.1, 257.3, 257.6, 257.7; 119/1

[56] References Cited

U.S. PATENT DOCUMENTS

| | | | |
|---|---|---|---|
| 3,986,744 | 10/1976 | Krogstad et al. | 294/1 R |
| 4,032,182 | 6/1977 | D'Ath | 294/19 R |

*Primary Examiner*—James B. Marbert
*Attorney, Agent, or Firm*—Ruth Moyerman

[57] ABSTRACT

A sanitary device, or pet valet, suitable for scavenging animal waste is disclosed. A box-like two-compartment container is utilized with a hand grip and finger trigger. The forward compartment is open on its bottom face and in use this compartment is placed over the refuse. A spring loaded face plate which divides the compartments is activated by the finger trigger. When released the plate pushes the debris rearwardly into the second compartment. The second rearward compartment acts as a holding area for the debris which may be emptied from this compartment by releasing a hinged bottom plate.

10 Claims, 4 Drawing Figures

SCAVENGING DEVICE FOR ANIMAL WASTE

BACKGROUND OF THE INVENTION

1. Field of the Invention

This invention relates to handling; hand forks and shovels, and more particularly to refuse scoops for animal litter.

2. Background of the Invention

In recent years the problem of pet sanitation is increasing in intensity, especially in crowded cities. More and more ordinances are being passed which require animal owners to remove excrement left by their pets on the public streets and sidewalks.

A good many devices have been proposed to facilitate the cleanup after pets, especially dogs.

The vast majority of these implements or devices, even though they may perform the function are clumsy, inefficient devices. For example, the majority of the prior art devices utilize a long handle or shaft, presumably to relieve the user from having to bend over to operate them. However, by their very design their purpose is obvious and their size unwieldy. The dog owner who uses them may find himself first of all spending inordinate time trying to achieve cleanup unless he is very dexterous. He may also find he is being avoided by his friends as he walks his dog when they see him approach carrying a device whose function is so obvious. U.S. Pat. Nos. 3,810,670 to Turi and 3,804,448 to Schmieler are typical of these devices. A handgrip device would be more unobtrusive. One hand grip device has been proposed but this device is not, however, easy to either use or carry. U.S. Pat. No. 3,986,744 to Krogstad et al is difficult to comfortably carry when filled in that the plastic bag which is the receiver for the debris would have to be held away from the pet owner's body to insure that the full bag does not burst or slip off the handle means. Furthermore, the device operates by a hand squeeze which an older person may find too difficult to operate.

Other pet valet devices of the prior art additionally have a great many moving parts that constant cleaning may cause to corrode and become inoperable.

No device is known which is simultaneously inexpensive to produce, easy to operate and clean yet, while containing these elements, remains unobtrusive in design and compact in size.

SUMMARY OF THE INVENTION

The aforementioned prior art problems are obviated by the device of this invention in which a two-compartment container with a hand grip is provided.

The device is generally parallelepipedal in shape and the two compartments are formed by a movable face plate. The forward compartment section is open at its bottom end and this is the section of the container placed over the debris. In operation, the face plate is locked into position near the front of the first compartment and is held in this position under positive tension created by a coiled spring. After the compartment is placed over the debris a finger trigger operates to release the face plate which springs forward pushing the debris backward into the second holding compartment. The holding compartment has a hinged bottom which may be released when the user wishes to empty the device. A liner may be provided.

The entire device may be of an overall size no larger than approximately that of a shoe box and may easily and conveniently be carried by the pet owner either by the handle or under his arm in the same manner as any ordinary box of that size might be transported.

It therefore is an object of this invention to provide a device suitable for collecting and storing the excrement of an animal in a sanitary, efficient manner.

It is a further object of this invention to achieve the aforesaid purpose by a device which is easy to use but unobtrusive in its appearance.

It is yet another object of this invention to provide a device with few moving parts such that it is relatively maintenance free.

It is still another object of this invention to provide a pet valet which is equally operational with or without auxilliary disposable liners.

These and other objects will be more readily apparent to those skilled in the art from a consideration of the following Figures, description and exemplary embodiments.

DETAILED DESCRIPTION OF THE PREFERRED EMBODIMENT

Figure 1:
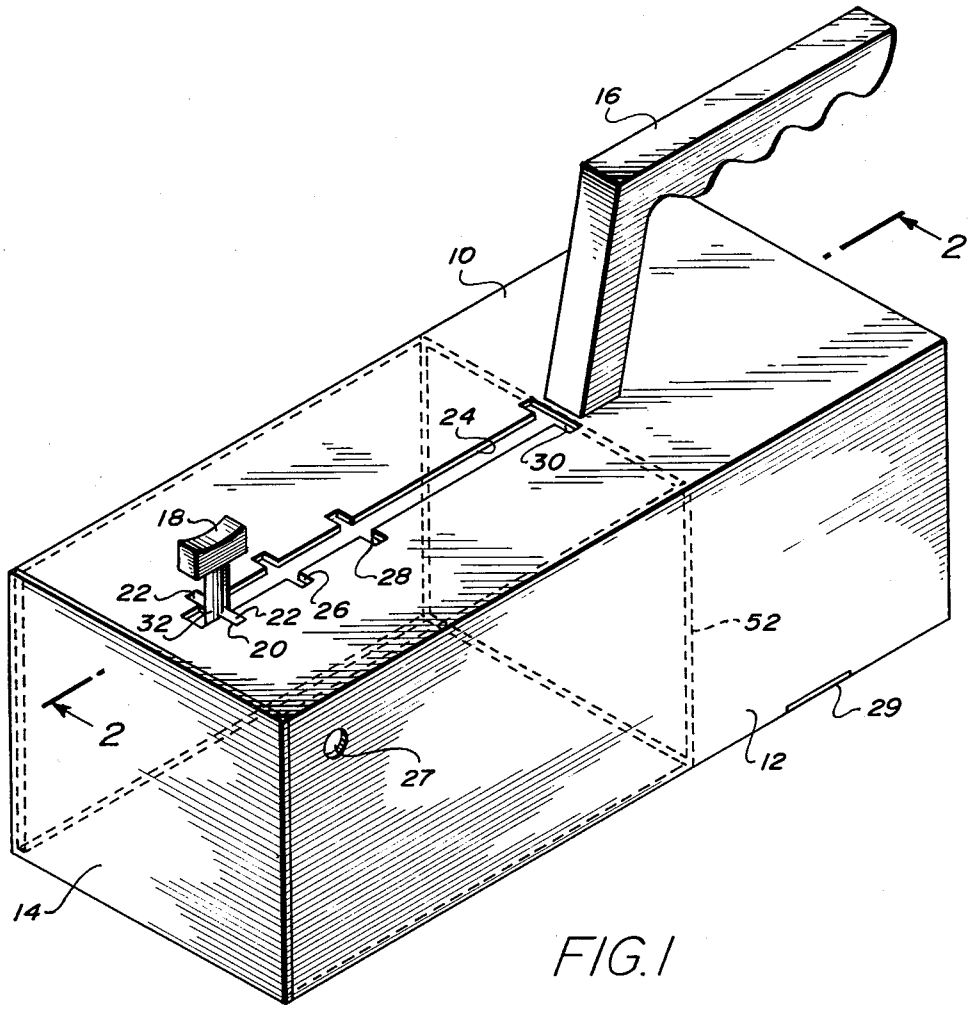
FIG. 1 is a perspective view of an embodiment of this invention including some of the parts in phantom.

Referring now to the drawings and more particularly to FIG. 1 the scavenging device is shown with top 10, sides 12 and front 14. Handle 16 is shown attached to top 10. Finger trigger 18, part of the mechanism to be described in more detail later, is shown engaged in slot 20. By engaged is meant that tab 22 which is of a size exactly designed to mate with slot 20 is shown mated therein, e.g. in the engaged position. Top 10 is shown additionally with slit 24 and further slots 26, 28 and 30. Slots 26, 28 and 30 perform the same function as slot 20. The tab and slots are preferably of tapered design to allow the tab to rest within the slot but preventing the tab from disengaging by popping out. Additionally, the device in FIG. 1 is shown with aperture 27 which in this example is of a size and shape adapted to allow the device to be hung on a nail or other suitable receiver when not in use. Slit 29 is shown near the bottom of side 12. Slit 29 is adapted to receive a slide tab bolt. The two compartment feature of this invention shown in phantom in FIG. 1 will be described in more detail in connection with FIGS. 2 and 3.

Figure 2:
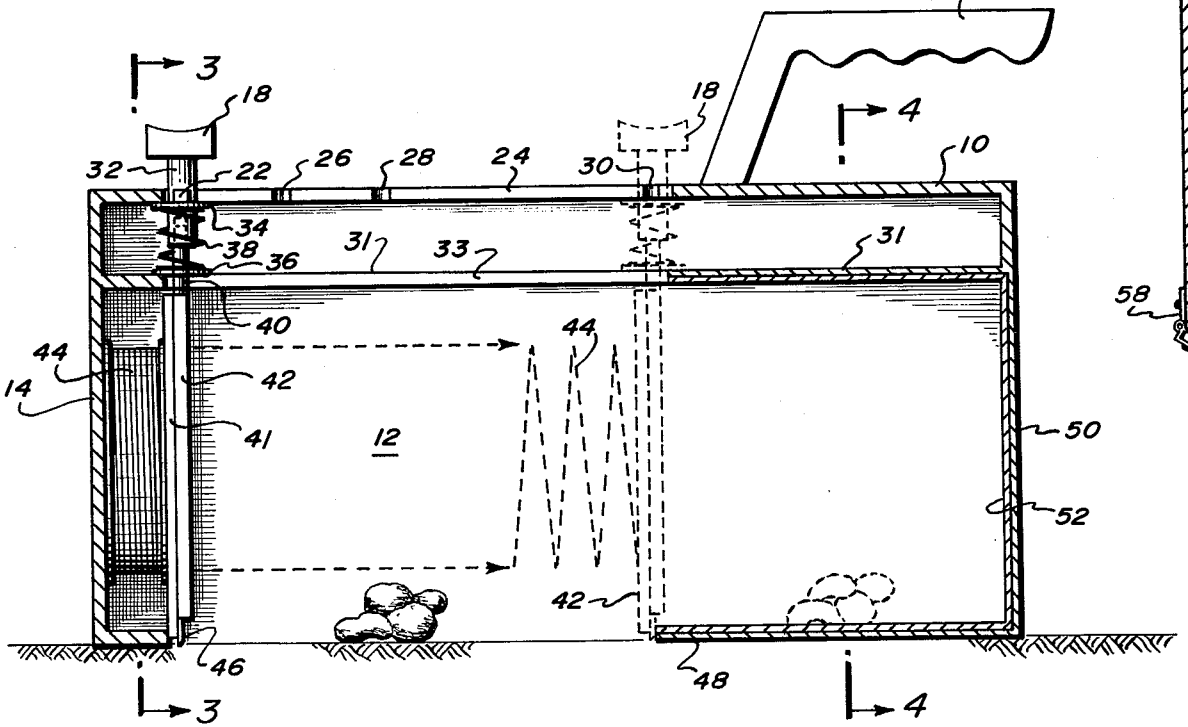
FIG. 2 is a side view of the device of this invention including showing the device in operation in phantom.

Referring now to FIG. 2, finger trigger 18 with tab 22 is shown engaged as described previously for FIG. 1, and again in phantom in an engaged position near handle 16. To engage finger trigger 18 and tab 22 it is necessary to merely move the finger trigger along slit 24 until tab 22 aligns with any of the slots 20, 26, 28 or 30. When the tab and slot are aligned, spring 38 will operate to urge the tab into the slot.

The interior of the sanitary device is more readily seen in FIG. 2 and includes inner top 31 which has slit 33 corresponding to slit 24 shown in top 10. Finger trigger 18 extends through slit 24 by means of shaft 32 and washer 34. Tab 22 is mounted on shaft 32 and washer 34 is likewise fixed on shaft 32. Washer 34, which is an ordinary washer, and corresponding washer 36 are separated by spring 38. Shaft 32 is partially hollow and serves as a receiver for face plate shaft 40. Washer 36 is mounted on face plate shaft 40. Face plate 42 which acts as a scraper for the animal waste is shown in its full open position in FIG. 2, in which position it is under maximum tension from spring 44. Face plate 42 and spring 44 are also shown in phantom in FIG. 2 in full closed position. Doctor blade 46 is shown attached to the bottom of face plate 42 and it is doctor plate 46 which rides along the ground during the scavenging operation.

In the full closed position shown in phantom in FIG. 2 the two-compartment aspect of the scavenging device is most readily ascertainable. The rearward receptacle compartment is shown with bottom 48 and back wall 50 which together with inner top 30 and face plate 42 form a sealed compartment. FIG. 2 is also shown with liner 52 which is designed to fit within the rearward compartment with its only open face positioned toward scraper face plate 42. Reinforcing rib 41 is provided on face plate 42 to stabilize the face plate in movement.

Figure 3:
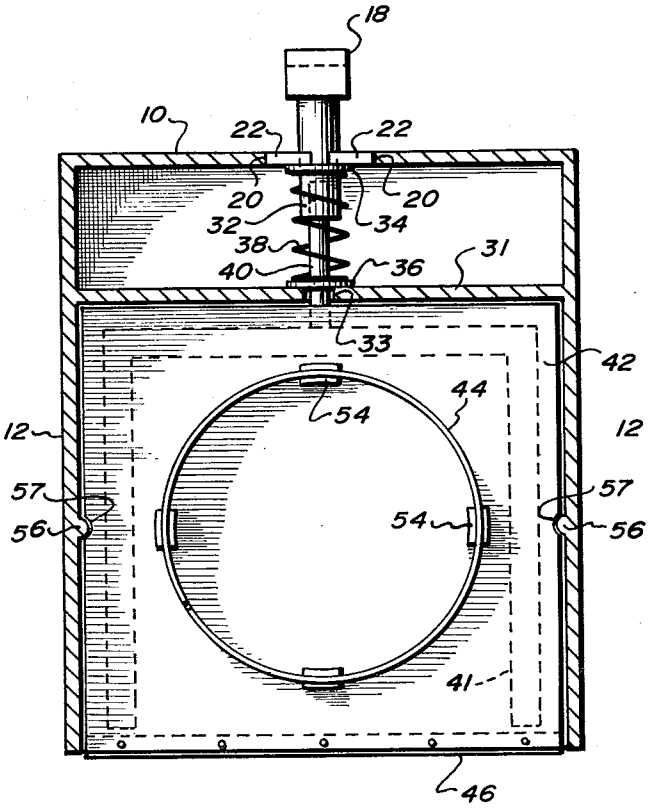
FIG. 3 is a vertical section taken on lines 3—3 of FIG. 2.

Referring now to FIG. 3, which is a section taken on FIG. 2 at lines 3—3, greater details of face plate 42 are now visible. Spring 44 is shown with spring fasteners 54 by which spring 44 is positioned and held on face plate 42 and front 14.

Rib stabilizers 56 are shown on each of sides 12 and their function is to stabilize the motion of scraper face plate 42 during movement of the face plate. Scraper face plate 42 has grooves 57 corresponding in size to mate with ribs 56 to provide the stabilizing function.

Figure 4:
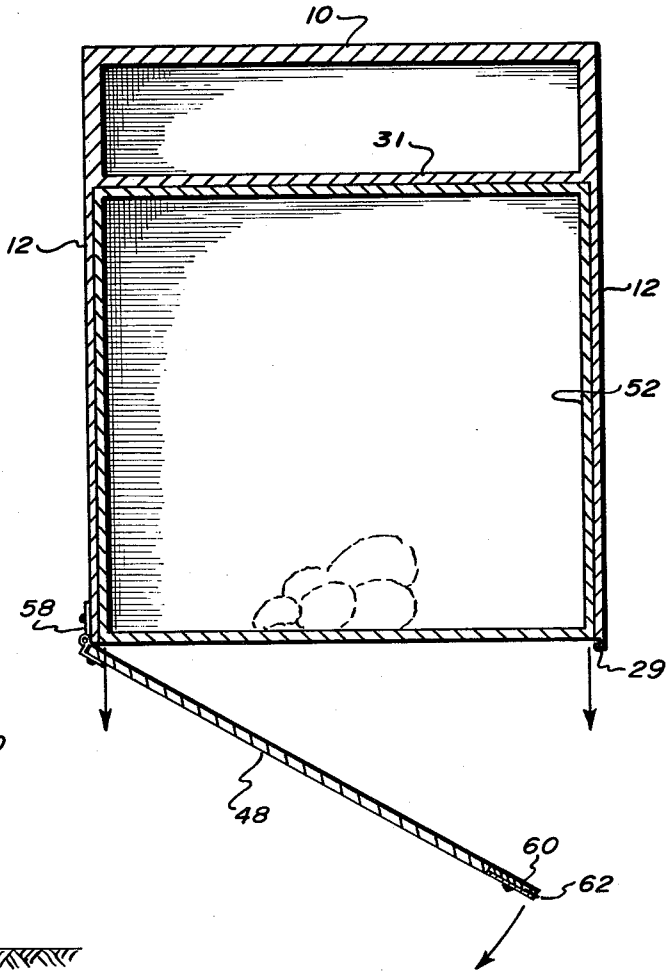
FIG. 4, taken on lines 4—4 of FIG. 2, shows a back vertical section of the device.

Referring now to FIG. 4 which is a section taken on lines 4—4 of FIG. 2, bottom plate 48 is shown in the open position to allow removal of liner 52 with the contents. Liner 52 is sized to easily slide out the bottom. Bottom plate 48 is attached to side 12 by hinges 58 on its one side and is provided with a locking device 60 on its other side. Locking device 60 is shown as a slide bolt arrangement and bolt 62 is adapted to fit into slit 29 thereby securing bottom plate 48 in place.

In operation the user secures face plate 42 in the full or partially full open position, places the sanitary device over the animal waste to be removed and releases the mechanism by pushing down on finger trigger 18 to allow the spring action of spring 44 to urge scraper face plate 42 forward, pushing the waste rearwardly with it. Face plate 42 in its full closed position is engaged in slit 30 and rests against liner 52 to arrest its motion. In this position it sealingly abuts liner 52 to provide a closed compartment for the waste material. Later after the dog owner has returned home, the contents may be emptied by releasing bottom plate 48, removing liner 52 and emptying the contents. Liner 52 is preferably made of a plastic or other water resistant material to enable it to be rinsed frequently without danger of corrosion.

When not in use the sanitary device of this invention may be stored or hung by means of aperture 27 or other fastening devices well known to those skilled in the art.

There are many variations which may be practiced within the scope of this invention. For example, the finger trigger and the spring mechanism by which it works may be varied and still be within the scope of this invention. A rotating tab and lock method of engagement may be utilized with finger trigger 18 in which tab 22 turns before automatically popping into the slit. The size and shape of slits 20, 24, 26, 28 and 30 as well as mating tab 22 are not critical and may be of any size and shape as may be conveniently manufactured.

The overall dimensions of the sanitary device are likewise not critical but are conveniently about the size of a shoe box. Handle 16 may be of any variety and type and it is not meant to limit the scope of this invention to the right angle handle shown in the drawings.

The device of this invention has many advantages. Chiefly among these is its compact size and ease of operation.

Secondly, in as much as the working parts of the device are not visible to the casual observer, the function of the device may be obscured from the casual observer and thereby not embarrass the pet owner.

Thirdly, the device has few moving parts and is thus relatively easy to operate and to clean.

The use of the optional liner enables the pet owner to take advantage of disposable liners which would further enhance the sanitation aspect of the operation or, in the alternative, provide a non-disposable liner which is inexpensive and easy to clean and reuse.

Having now described and illustrated my invention, it is not intended that such description limit this invention, but rather that this invention be limited only by a reasonable interpretation of the apended claims.

What is claimed is:

1. A device for scavenging and storing animal waste comprising:
   (a) a generally parallelepipedal housing having a first outer top and a second inner top, a front wall, a rear wall, two side walls, and a partial bottom wall releasably attached to said housing;
   (b) a scraper face plate slidably mounted within the housing between the sides along a path from proximate said front wall wherein said plate is in full open position to a position toward said back wall, proximate said bottom wall, wherein said scraper plate is in full closed position and thereby sealingly abuts said sides, said inner top and said bottom to form a waste receptacle compartment;
   (c) tension means mounted between said front wall and connected to said scraper face plate so that said scraper plate is continuously urged toward said back wall;
   (d) means extending through said inner and said outer top for releasably securing said scraper face plate at various locations along its path; and,
   (e) handle means for carrying and positioning said device whereby when the device is rested on a generally planar surface with the open compartment of the bottom overlying the waste, movement of the scraper face plate from an open to a closed position pushes said waste into said waste receptacle compartment.

2. A device according to claim 1 in which said tension means comprise a helical spring.

3. A device according to claim 1 which contains additionally a liner generally parallelepipedal in shape with one end open wherein said liner is adapted to fit co-extensively within said waste receptacle section with said open portion facing said front wall.

4. The device according to claim 1 in which said scraper face plate additionally contains a resilient doctor blade along its bottom edge to aid in the scavenging of waste into said waste receptacle.

5. A device according to claim 1 in which the means for releasing and securing said scraper face plate include a tab and receiver means adapted to be operated with a finger trigger.

6. The device according to claim 5 in which the tab and receiver means are spring actuated.

7. The device according to claim 1 including stabilizing means to align said face plate as it moves along its path.

8. The device according to claim 1 in which said handle means comprise a right angle member attached to said top on one of its ends.

9. The device according to claim 1 in which said bottom wall is attached by hinges to said one side wall.

10. The device according to claim 9 in which said bottom is attached to said other side wall by slide bolt means.

* * * * *